US008818654B2

(12) United States Patent
Koguchi et al.

(10) Patent No.: US 8,818,654 B2
(45) Date of Patent: Aug. 26, 2014

(54) OUTPUT CONTROL APPARATUS OF ENGINE

(71) Applicant: JATCO Ltd, Fuji (JP)

(72) Inventors: Takashi Koguchi, Yokohama (JP); Kazunori Sugiura, Okazaki (JP); Shin Tsukamoto, Isehara (JP); Shohei Imaji, Sagamihara (JP); Yoshiyuki Egawa, Isehara (JP)

(73) Assignee: JATCO Ltd, Fuji-shi (JP)

( * ) Notice: Subject to any disclaimer, the term of this patent is extended or adjusted under 35 U.S.C. 154(b) by 0 days.

(21) Appl. No.: 13/785,881

(22) Filed: Mar. 5, 2013

(65) Prior Publication Data

US 2013/0261906 A1 Oct. 3, 2013

(30) Foreign Application Priority Data

Mar. 28, 2012 (JP) ..... 2012-074954

(51) Int. Cl.
*F02D 29/02* (2006.01)

(52) U.S. Cl.
USPC ..... 701/51; 701/54

(58) Field of Classification Search
USPC ..... 701/51, 54, 67, 61, 58; 477/143
See application file for complete search history.

(56) References Cited

U.S. PATENT DOCUMENTS 5,050,454 A * 9/1991 Yamaguchi et al. ..... 477/109
5,921,884 A * 7/1999 Nishiwaki et al. ..... 477/61
2008/0033618 A1* 2/2008 Kwon ..... 701/54

FOREIGN PATENT DOCUMENTS

JP 06-101510 A 4/1994
JP 2003-269206 A 9/2003

* cited by examiner

*Primary Examiner* — Marthe Marc-Coleman
(74) *Attorney, Agent, or Firm* — Foley & Lardner LLP

(57) ABSTRACT

Engine output control apparatus has shift range detecting section detecting shift range of automatic transmission; vehicle speed detecting section detecting vehicle speed; engine output state detecting section detecting engine output state; and controller. The controller performs (a) judgment control judging that torque converter is in a stall state if following judgment conditions (i) to (iii) are satisfied, (i) shift range is drive range, (ii) vehicle speed is equal to or less than predetermined vehicle speed, (iii) engine is in a high output state, (b) cumulation control cumulating a period of agreement of the judgment conditions if the judgment conditions are satisfied, and (c) output suppression control suppressing output of the engine if a control start condition is satisfied by cumulation of the agreement period. The control start condition is set so that as the vehicle speed becomes higher, start of the output suppression control is more delayed.

9 Claims, 5 Drawing Sheets

OUTPUT CONTROL APPARATUS OF ENGINE

BACKGROUND OF THE INVENTION

The present invention relates to an output control apparatus of an engine of a vehicle that mounts thereon an automatic transmission having a torque converter.

In a vehicle having an automatic transmission into which an engine output is inputted through a torque converter, there could occur a stall of the torque converter. That is, there occurs such stall as a rotation speed difference (a slip) between a pump at an input side and a turbine at an output side of the torque converter increases by the fact that even if the engine output is adequately produced, although the pump rotates, the turbine stops. When this stall occurs, oil (generally, ATF: Automatic Transmission Fluid) that transmits torque from the pump at the input side to the turbine at the output side receives a shearing stress and generates heat. Further, if the stall continues, the oil in the torque converter is overheated, and this leads to thermal degradation (heat deterioration) of the oil with time and a decrease in durability of a seal member etc. provided inside the torque converter due to the heat generation of the oil.

In addition, in a state in which the vehicle does not stop, although the turbine also does not stop in the torque converter, since a rotation speed of the turbine is extremely low when the vehicle is in an extremely low speed region close to a vehicle starting speed, a stall state in which the rotation speed difference between the pump and the turbine in the torque converter increases occurs, and oil temperature increases likewise.

Thus, techniques for preventing the overheat of the oil, which when the stall or the stall state (hereinafter, simply called the "stall state") of the torque converter continuously occurs, decreases the rotation speed difference between the pump at the input side and the turbine at the output side by reducing the engine output, have been proposed.

In Japanese Patent Provisional Publication No. 6-101510 (hereinafter is referred to as "JP6-101510"), as a condition (hereinafter, called a "stall estimation condition") by which the torque converter is estimated to be in the stall state, "a drive range is selected" and "a vehicle speed is in the extremely low speed region that is lower than or equal to a predetermined vehicle speed" and "an engine output state is in a high output state" (these are "and"-condition) are disclosed. Then, when this condition is continuously satisfied for more than or equal to a predetermined time, the engine output is controlled to be reduced.

In Japanese Patent Provisional Publication No. 2003-269206 (hereinafter is referred to as "JP2003-269206"), as same as JP6-101510, as the stall estimation condition, "the drive range is selected" and "the vehicle speed is in the extremely low speed region that is lower than or equal to a predetermined vehicle speed" and "the engine output state is in the high output state" (these are "and"-condition) are disclosed. Then, when this condition continues for more than or equal to a predetermined time, the engine output is controlled to be reduced for only a setting time. Further, in JP2003-269206, in a case where the stall state is detected again within the predetermined time after the reduction control of the engine output is cancelled, if this stall state continues for more than or equal to a second predetermined time that is set to be shorter than the predetermined time, the engine output is controlled to be reduced. With this control, even if the stall state continually (intermittently) occurs, the overheat of the oil in the torque converter can be prevented.

SUMMARY OF THE INVENTION

Here, when the vehicle is in an extremely low speed travel state in which a high torque is required and also the vehicle speed is hard to increase, such as circumstances where the vehicle travels on a steep slope or where the vehicle travels while towing a vehicle on a flat road or the slope, there is a case where the vehicle speed that is a speed included in a slightly lower vehicle speed than the above predetermined vehicle speed, i.e. the vehicle speed included in the extremely low speed region, continues, in addition to the stall estimation condition of "the drive range is selected" and "the engine output state is in the high output state".

In this case, if the techniques of JP6-101510 and JP2003-269206 are applied to the vehicle, the stall estimation condition is satisfied, then the reduction control of the engine output is carried out. As a consequence, there is a risk that the vehicle will fall into a non-travelling state, for instance, the vehicle stops or slips down on the slope. It is therefore desirable to avoid this non-travelling state as much as possible.

However, even in a case where the vehicle speed is the slightly lower vehicle speed than the above predetermined vehicle speed, namely even in a case where the vehicle travels at a relatively high vehicle speed within the extremely low speed region, if the engine is in the high output state and this state continues, the oil temperature of the torque converter increases and is overheated. Suppression of the increase of the oil temperature is therefore needed too.

For these problems, it is therefore an object of the present invention to provide an engine output control apparatus of the vehicle which is capable of avoiding non-travelling state as much as possible even in the case where the high torque is required and also the vehicle travels at the extremely low vehicle speed and suppressing the increase in the temperature and the overheat of the oil in the torque converter.

According to one aspect of the present invention, an engine output control apparatus of a vehicle, the vehicle mounting thereon an automatic transmission that transmits an engine output inputted through a torque converter to driving wheels of the vehicle, the engine output control apparatus comprises: a shift range detecting section that detects a shift range of the automatic transmission; a vehicle speed detecting section that detects a vehicle speed of the vehicle; an engine output state detecting section that detects an output state of an engine; and a controller. The controller performs, on the basis of each detection information of the shift range detecting section, the vehicle speed detecting section and the engine output state detecting section, the following controls, (a) a judgment control that judges that, if the following judgment conditions (i) to (iii) are satisfied, the torque converter is in a stall state,
  (i) the shift range is a drive range,
  (ii) the vehicle speed is equal to or less than a predetermined vehicle speed, and
  (iii) the engine is in a high output state,
(b) a cumulation control that cumulates a period of agreement of the judgment conditions if the judgment conditions are satisfied, and
(c) an output suppression control that suppresses the output of the engine if a control start condition is satisfied by the cumulation of the agreement period.

And, the control start condition is set so that as the vehicle speed becomes higher, a start of the output suppression control is more delayed.

In the present invention, it is preferable that the engine output state detecting section is an engine revolution speed sensor that senses a revolution speed of the engine.

In the present invention, it is preferable that, the cumulation control executes a count operation that adds a count-up value to a count value at a predetermined control interval if the judgment conditions are satisfied, and the output suppression control judges that the control start condition is satisfied and starts the output suppression control if the count value is equal to or greater than a predetermined count threshold value, and the count-up value are set on the basis of the vehicle speed detected at each predetermined control interval so that as the vehicle speed becomes higher, the count-up value becomes smaller.

In the present invention, it is preferable that, the engine output control apparatus further comprises an accelerator operation detecting section that detects presence/absence of an accelerator operation of the vehicle, and in a case where the judgment conditions are not satisfied after the start of the output suppression control, if the accelerator operation is not detected by the accelerator operation detecting section, the cumulation control executes a count operation that subtracts a count-down value from the count value, and the output suppression control judges that a control end condition is satisfied with the disagreement of the judgment conditions being the control end condition, and terminates the output suppression control.

In the present invention, it is preferable that, in a case where the judgment conditions are not satisfied after the start of the output suppression control, if the accelerator operation is detected by the accelerator operation detecting section, the cumulation control executes a count operation that maintains the count value.

In the present invention, it is preferable that, in a case where the judgment conditions are not satisfied before the start of the output suppression control, the cumulation control executes a count operation that subtracts a count-down value from the count value.

In the present invention, it is preferable that, if the shift range of the automatic transmission is a neutral range, the cumulation control executes a count operation that subtracts a count-down value from the count value.

In the present invention, it is preferable that, the engine output control apparatus further comprises a temperature sensor that senses a temperature of oil supplied to the torque converter, and if the oil temperature sensed by the temperature sensor is equal to or lower than a predetermined temperature, the controller judges that the judgment conditions are not satisfied.

For instance, the temperature sensor senses a temperature of the oil stored in an oil pan.

In the present invention, it is preferable that, the output suppression control is a control that stops a part of or all of fuel supply to the engine.

For instance, the output suppression control stops fuel injection for a part of or all of cylinders in the engine having a plurality of the cylinders.

According to the engine output control apparatus of the vehicle of the present invention, if the shift range is the drive range and the vehicle speed is equal to or less than the predetermined vehicle speed such as the extremely low speed and the engine output state is the high output state, the judgment conditions are satisfied and the judgment control judges that the torque converter is in the stall state in which the slip of the torque converter increases.

During a period of the agreement of these judgment conditions, since the torque converter is in the stall state, the oil temperature increases. However, during the extremely low speed travel in which the vehicle speed is higher than a speed of vehicle start at which the stall occurs, the slip of the torque converter becomes relatively small, and the increase of the oil temperature in the torque converter becomes relatively gentle. That is, at the time of the agreement of the judgment conditions, as the vehicle speed becomes higher, the increase of the oil temperature in the torque converter becomes gentler.

The control start condition, which is satisfied when the agreement period of the judgment conditions is cumulated, is set so that as the vehicle speed becomes higher, the start of the output suppression control that suppresses the output state of the engine is more delayed. Thus, the control start condition is the condition set so as to delay the start of the output suppression control in accordance with the increase characteristic of the oil temperature in the torque converter which indicates that as the vehicle speed becomes higher, the temperature increase of the oil becomes gentler.

Therefore, in the case where the high torque is required and the vehicle travels at the extremely low vehicle speed, the judgment conditions are satisfied, and at this time, as the vehicle speed becomes higher, the start of the output suppression control that suppresses the output state of the engine is more delayed. Hence, the non-travelling state of the vehicle can be avoided as much as possible, and also the temperature increase and overheat of the oil in the torque converter can be suppressed.

The other objects and features of this invention will become understood from the following description with reference to the accompanying drawings.

BRIEF DESCRIPTION OF THE DRAWINGS

FIG. 7A shows time-variation of a vehicle speed V, and FIG. 7B shows time-variation of a count value Kp, with both time series brought into alignment with each other.

DETAILED DESCRIPTION OF THE INVENTION

Embodiments of the present invention will now be explained below with reference to the drawings.

One Embodiment

An engine output control apparatus according to the present embodiment is an apparatus that is applied to a vehicle, such as an automobile, mounting thereon an automatic transmission.

[1. Drive and Driveline System]

The drive and driveline system will be explained with reference to FIG. 1 that shows a system of main parts of the vehicle.

Figure 1:
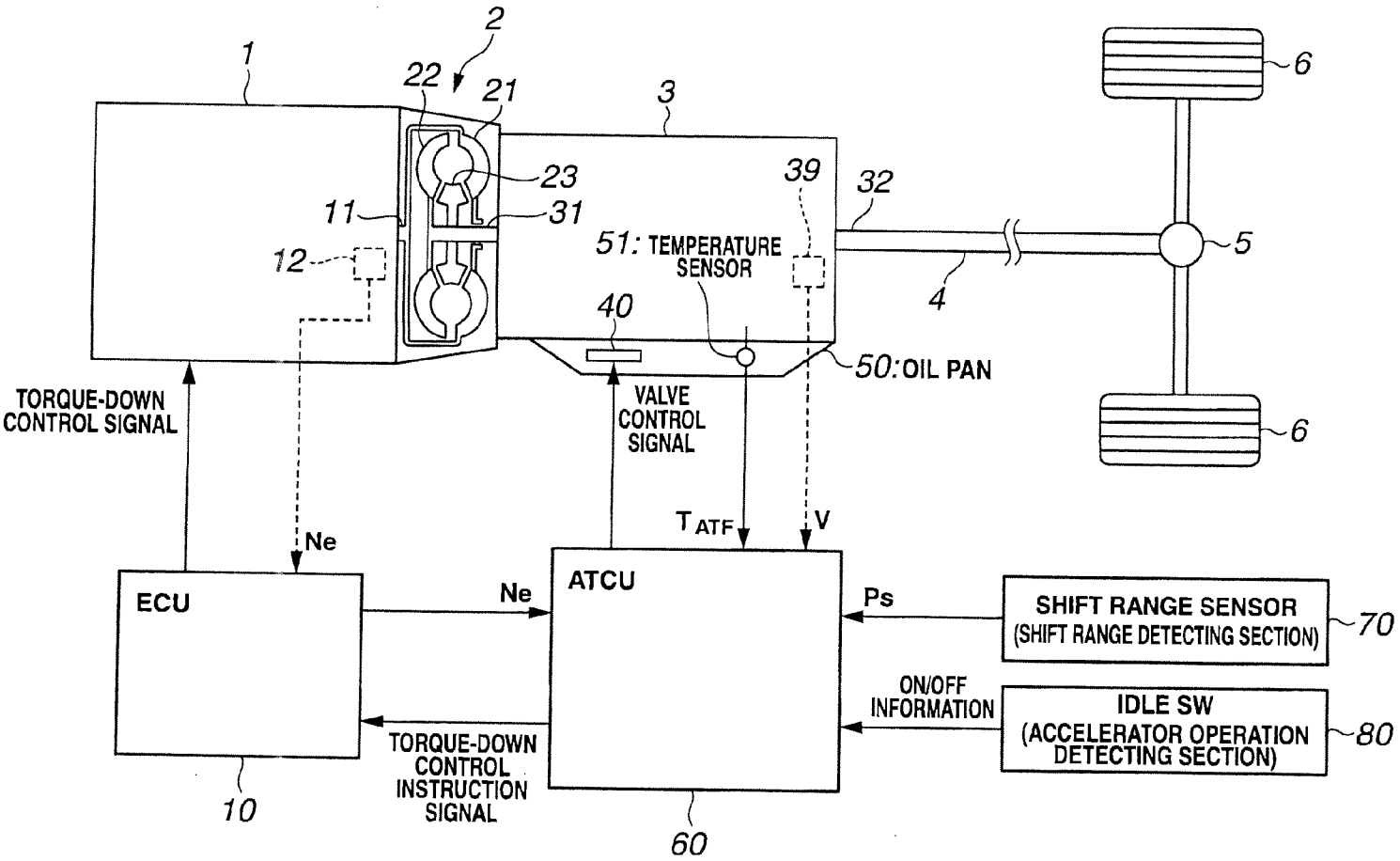
FIG. 1 is a block diagram showing an engine output control apparatus and a system of main parts of a vehicle, according to one embodiment of the present invention.

As shown in FIG. 1, the vehicle of the present embodiment has an engine 1 that is a driving source of the vehicle, an automatic transmission 3 and a torque converter 2 arranged between an output shaft 11 of the engine 1 and an input shaft 31 of the automatic transmission 3 and having a pump 21 at an input side and a turbine 22 at an output side. An output shaft 32 of the automatic transmission 3 is connected to right and left driving wheels 6, 6 through the driveline system such as a propeller shaft 4 and a differential gear 5. A driving force of the engine 1 is then transmitted to the driving wheels 6, 6 of the vehicle through the torque converter 2 and the automatic transmission 3.

The engine 1 has a plurality of cylinders, and is provided with an engine revolution speed sensor (an engine rpm sensor) (an engine output state detecting section) 12 which senses or detects an engine revolution speed Ne that changes according to a revolution speed of the output shaft 11 of the engine 1, i.e. according to an output state of the engine 1. Here, the revolution speed such as the engine revolution speed Ne and an after-mentioned output shaft revolution speed of the automatic transmission 3 indicates the number of revolutions per unit time, and corresponds to a rotation speed.

In the torque converter 2, the pump 21 connected to the output shaft 11 of the engine 1 and the turbine 22 connected to the input shaft 31 of the automatic transmission 3 are coaxially aligned with each other and can relatively rotate. Between these pump 21 and turbine 22, a stator 23 that is connected to the input shaft 31 of the automatic transmission 3 is provided. Further, a one-way clutch is provided between the stator 23 and the input shaft 31.

The torque converter 2 transmits an output of the engine 1, which is inputted to the pump 21 of the torque converter 2, to the turbine 22 and then to the automatic transmission 3 while amplifying or maintaining a torque by the stator 23 via oil (generally, ATF: Automatic Transmission Fluid, hereinafter, also called "ATF") that is supplied in the torque converter 2 as a power transmitting medium.

The automatic transmission 3 is provided with a gear mechanism (not shown) between the input shaft 31 and the output shaft 32. This gear mechanism has frictional engagement elements of a clutch and a brake (each, not shown) for selecting and using a required gear pair from among a plurality of gear pairs. Each frictional engagement element engages/disengages in accordance with a supplied oil pressure (a supplied hydraulic pressure), and a required gear stage (a required shift position) is achieved by combination of the engagement/disengagement of the frictional engagement element according to a selected shift position.

As the automatic transmission 3, instead of the above multi-range transmission or a stepwise variable transmission, a belt-type or chain-type continuously variable transmission or a toroidal CVT could be used.

The automatic transmission 3 outputs the output of the engine 1, which is inputted to the automatic transmission 3 through the torque converter 2, in a required transmission ratio, and transmits it to the driveline system such as the propeller shaft 4 and the differential gear 5.

The automatic transmission 3 is provided with a vehicle speed sensor (a vehicle speed detecting section) 39 which senses or detects the revolution speed of the output shaft 32 of the automatic transmission 3, namely a revolution speed corresponding to a vehicle speed V.

Information (detection information) of this revolution speed corresponding to the vehicle speed V detected by the vehicle speed sensor 39 is sent to an ECU (Electronic Control Unit) 10.

As shown in FIG. 1, an oil pan 50 in which the ATF is stored is provided under the automatic transmission 3.

The ATF is used as a working fluid (a hydraulic fluid) for operation of the torque converter 2 and the automatic transmission 3, namely for the power transmission of the torque converter 2 and the engagement/disengagement of the frictional engagement element of the gear mechanism in the automatic transmission 3, and also used as lubricant (a lubricating oil) for lubrication of the torque converter 2 and the automatic transmission 3.

The oil pan 50 is provided with a control valve 40 installed in a valve body (not shown) that is immersed in the ATF and a temperature sensor 51 that detects an ATF temperature (an oil temperature) $T_{ATF}$ in the oil pan 50.

The control valve 40 works on the basis of a valve control signal from an after-mentioned ATCU 60. The control valve 40 switches oil passages, where the ATF flows or circulates, of the valve body and regulates or controls the oil pressure used for the engagement/disengagement control of the frictional engagement element of the gear mechanism in the automatic transmission 3.

Information of the ATF temperature $T_{ATF}$ detected by the temperature sensor 51 is sent to the ATCU 60.

The vehicle has a shift lever (not shown) by which a driver performs a selecting operation of the shift position (the gear stage) and an accelerator pedal (not shown) by which the driver performs an accelerator operation.

A shift range sensor (a shift range detecting section) 70 detects each shift range (shift position) such as D (drive)-range and R (reverse)-range of a drive range and N (neutral)-range and P (parking)-range of an un-drive range (or non-drive range), which is selected by the driver's shift lever operation. As the shift range sensor 70, for instance, it could be possible to use an inhibitor switch in which a contact is switched in response to the selection of the shift range and which inhibits a start of an engine starter motor except for the N-range and the P-range.

Shift range information (detection information) Ps detected by the shift range sensor 70 is sent to the ATCU (a controller or a control apparatus, Automatic Transmission Control Unit) 60.

An idle switch (an accelerator operation detecting section) 80 detects presence or absence of the accelerator operation. When this idle switch 80 is ON, the accelerator operation is not performed. When the idle switch 80 is OFF, the accelerator operation is performed.

ON/OFF information (detection information) detected by the idle switch 80 is sent to the ATCU 60.

[2. Outline of Control Apparatus]

The vehicle is provided with an ECU 10 and the ATCU 60 which are the controllers or control apparatuses of the engine 1 and the automatic transmission 3. These ECU 10 and ATCU 60 are electronic control units configured as an LSI device on which a microprocessor, ROM, RAM, etc. are mounted or a built-in or an embedded electronic device. The ECU 10 and the ATCU 60 are connected with each other through a communication medium such as a CAN (Controller Area Network).

The ECU 10 is a controller that controls an extensive system for the engine 1. As objects of the control by the ECU 10, for instance, they are an ignition timing of an ignition plug and a fuel injection quantity of fuel injected by an injector in the engine 1. However, the following description focuses attention on an engine output control that is related to the present embodiment, and will explain it.

The ECU 10 inputs information of the engine revolution speed Ne (hereinafter, simply called the "engine revolution speed Ne") from the engine revolution speed sensor 12, and performs the control of the engine 1 in accordance with a control instruction signal from the ATCU 60. The engine revolution speed Ne inputted to the ECU 10 is outputted and sent to the ATCU 60.

In the following description, a torque-down control (an output suppression control) that suppresses the output of the engine 1, performed by the ECU 10, will be explained.

The torque-down control is executed by the fact that the ECU 10 outputs a torque-down control signal to the engine 1 when a torque-down control instruction signal is inputted to the ECU 10 from the ATCU 60. That is, the ECU 10 outputs, to the engine 1, a control instruction signal that, for example, stops the fuel injection for a part of or all of the cylinders in the engine 1 having a plurality of the cylinders and stops a part of or all of fuel supply to the engine 1 (i.e. carries out fuel-cut).

As the torque-down control, it is not limited to the control that carries out the fuel-cut. A retard control that retards the ignition timing, a control which suppresses the output of the engine 1 by a throttle control etc. that decrease a throttle opening regardless of an accelerator opening although drive-by-wire is required as a premise, might be used as the torque-down control.

During execution of the torque-down control, in order to prevent an engine stall, a lower limit of the engine revolution speed Ne is set to or kept to an idle revolution speed or an idle-up revolution speed.

The ATCU 60 is a controller that controls an extensive system for the automatic transmission 3. As objects of the control by the ATCU 60, for instance, they are an operation of the control valve 40 and the control signal of the ECU 10 to the engine 1.

The ATCU 60 inputs the information (hereinafter, simply called "information of the vehicle speed V") of the revolution speed corresponding to the vehicle speed V from the vehicle speed sensor 39, the information of the ATF temperature $T_{ATF}$ detected by the temperature sensor 51, the shift range information Ps detected by the shift range sensor 70, the ON/OFF information detected by the idle switch 80 and the information of the engine revolution speed Ne. The ATCU 60 performs various controls of the automatic transmission 3 using these information.

In the present embodiment, a protection control among the various controls by the ATCU 60 will be explained in detail below. The protection control suppresses an increase of the ATF temperature caused by an occurrence of a stall state in which a rotation speed difference (a slip) between the pump 21 and the turbine 22 in the torque converter 2 increases, and protects the ATF.

[3. Protection Control]

In the following description, the protection control executed by the ATCU 60 will be explained.

Here, an ATF temperature in the torque converter 2 can not be directly detected, and there is a response delay of the ATF temperature $T_{ATF}$ in the oil pan 50 detected by the temperature sensor 51 to the ATF temperature in the torque converter 2. Because of this, to suppress the ATF temperature that locally increases in the torque converter 2, the ATCU 60 executes the protection control using a count value Kp of a parameter for estimating the ATF temperature in the torque converter 2. More specifically, the ATCU 60 performs addition and subtraction of the count value Kp according to temperature change of the ATF in the torque converter 2. The count value Kp is reset (is set to 0 (zero)) when an ignition key is turned OFF.

[3.1. Precondition of Protection Control]

The protection control is executed when a condition (hereinafter, called a "protection control precondition") that is a prerequisite for the execution of this protection control is satisfied. The ATCU 60 judges this protection control precondition at a predetermined control interval.

The protection control precondition is "the ATF temperature $T_{ATF}$ detected by the temperature sensor 51 is higher than a predetermined temperature $T_{co}$". This predetermined temperature $T_{co}$ is a temperature previously set as an upper limit of the temperature of a cold state in which there is a need to increase the ATF temperature just after a vehicle start etc. For instance, 60° C. is set as this temperature.

That is, the ATCU 60 judges the protection control precondition using the information of the ATF temperature $T_{ATF}$ detected by the temperature sensor 51. If the ATF temperature $T_{ATF}$ is higher than the predetermined temperature $T_{co}$, the ATCU 60 judges that the protection control precondition is satisfied (judges agreement of the protection control precondition). If the ATF temperature $T_{ATF}$ is equal to or lower than the predetermined temperature $T_{co}$, the ATCU 60 judges that the protection control precondition is not satisfied (judges disagreement of the protection control precondition).

When the protection control precondition is not satisfied, if the torque-down control has been executed, the ATCU 60 outputs a control signal that indicates an end of the torque-down control (that instructs to terminate the torque-down control) to the ECU 10, and terminates the torque-down control. In this case, in an after-mentioned cumulative control (cumulation control), the ATCU 60 judges that a judgment condition is not satisfied.

[3.2. Explanation of Protection Control]

In the protection control, the following controls and judgment are executed; a judgment control that judges agreement/disagreement of a condition (hereinafter, simply called a "stall condition") that estimates whether the stall state in which the slip of the torque converter 2 increases occurs or not, a judgment of the start and the end of the above torque-down control (the output suppression control), and the cumulative control that performs, according to the above judgments, a count operation of the addition and the subtraction etc. of the count value Kp used for the judgment of the start of the torque-down control. These controls and judgment are executed by the ATCU 60 at the predetermined control interval.

[3.2.1. Judgment Control]

The judgment control judges a stall judgment precondition and the stall condition that is judged when this stall judgment precondition is satisfied.

The stall judgment precondition is "the shift range is the drive range". That is, in the judgment control executed by the ATCU 60, if the shift range detected by the shift range sensor 70 is the drive range, the judgment of the agreement/disagreement of the stall condition is performed. If the shift range is not the drive range, the judgment of the agreement/disagreement of the stall condition is not performed.

The stall condition is satisfied if the following both conditions (1) and (2) are satisfied (the stall condition is not satisfied if at least either one of both conditions (1) and (2) is not satisfied).

(1) the vehicle speed V is equal to or less than a predetermined vehicle speed $V_{TH}$ (2) the engine revolution speed Ne is equal to or greater than a predetermined revolution speed $Ne_{TH}$ The predetermined vehicle speed $V_{TH}$ is a vehicle speed previously set as a vehicle speed (an extremely low speed) close to a vehicle-stop speed. Here, in an engine revolution speed region used at the extremely low speed (an extremely low speed region) at which the vehicle speed V is equal to or less than the predetermined vehicle speed $V_{TH}$, in general, as the revolution speed Ne of the engine 1 increases, the output of the engine 1 becomes greater. Therefore, in a case where a certain (or constant) or more output is added to the torque converter 2 from the engine 1, the engine revolution speed Ne also becomes a certain (or constant) or more revolution speed.

Thus, in the present embodiment, the engine revolution speed Ne is used as a parameter for judging whether or not the engine 1 is in a high output state. The predetermined revolution speed $Ne_{TH}$ of the above (2) is a judgment threshold value for judging whether the engine 1 is in the high output state, and is previously set as a lower limit revolution speed of the engine revolution speed of the case where the engine 1 is in the high output state.

Accordingly, when both of the conditions (1) and (2) are satisfied, the rotation speed difference between the pump 21 whose rotation speed is the same as the engine revolution speed Ne that is predetermined revolution speed $Ne_{TH}$ or greater and the turbine 22 having a rotation speed according to the predetermined vehicle speed $V_{TH}$ increases, and then the slip of the torque converter 2 becomes great. The ATF temperature in the torque converter 2 then increases.

Further, the ATCU 60 judges the agreement/disagreement of the above stall judgment precondition and the stall condition (hereinafter, also called the "judgment condition") by the judgment control, and executes the cumulative control that cumulates (adds or totalizes) a period (a duration or a length) of the agreement of these conditions. More specifically, the cumulation of the agreement period by the cumulative control corresponds to the count operation.

In the count operation, when the judgment condition is satisfied, a count operation (a count-up operation) that performs the addition of the count value Kp is executed. When the judgment condition is not satisfied, a count operation (a count-down operation) that performs the subtraction of the count value Kp or a count operation (a count-maintaining operation) that maintains the count value Kp is executed.

[3.2.2. Judgment of Start and End of Torque-Down Control]

The ATCU 60 judges a condition (hereinafter, called a "control start condition") that starts the torque-down control and a condition (hereinafter, called a "control end condition") that terminates the torque-down control.

The control start condition is "the count value Kp is equal to or greater than a count threshold value $Kp_{TH}$.

The control end condition is "at least either one of the stall judgment precondition and the stall condition is not satisfied".

That is, when judging that the control start condition is satisfied, the ATCU 60 outputs a control instruction signal that starts the torque-down control to the ECU 10, while when judging that the control end condition is satisfied, the ATCU 60 outputs a control instruction signal that terminates the torque-down control to the ECU 10, then performs the torque-down control (the start and the end of the torque-down control).

Here, since the count-up of the count value Kp is performed upon the agreement of the stall condition, the control start condition is judged to be satisfied when the agreement period of the stall condition is cumulated.

The ATCU 60 memorizes or stores the agreement/disagreement of the control start condition, namely whether or not the torque-down control is started. More specifically, the ATCU 60 stores whether or not the count value Kp was equal to or greater than the count threshold value $Kp_{TH}$ in the past. In other words, the ATCU 60 stores a history of the execution of the torque-down control.

[3.2.3. Count-Up of Count Value]

The ATCU 60 performs the count operation that adds count-up values $Kp_1$~$Kp_4$ to the count value Kp when judging the both agreement of the stall judgment precondition and the stall condition (when judging that both of the stall judgment precondition and the stall condition are satisfied) by the judgment control. These count-up values $Kp_1$~$Kp_4$ are set so that as the vehicle speed V becomes higher, the count-up value becomes smaller.

The setting of the count-up values $Kp_1$~$Kp_4$ will be explained below with reference to experimental data in FIG. 2.

Figure 2:
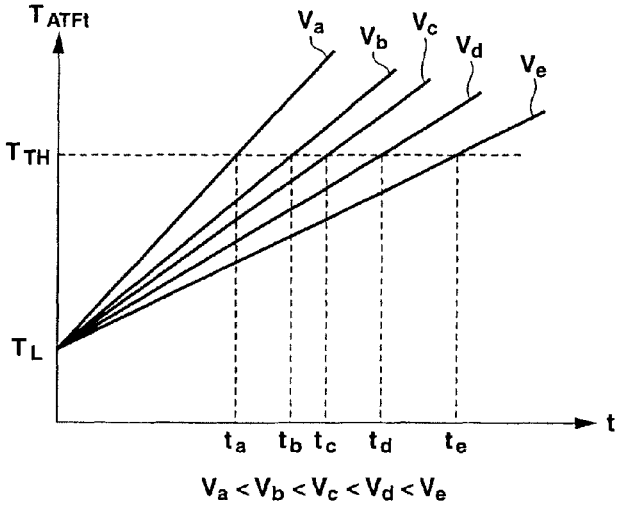
FIG. 2 is a diagram showing temperature-time characteristic of oil in a torque converter for each vehicle speed, in a stall state of the torque converter.

FIG. 2 shows time-variation of an ATF temperature $T_{ATFt}$ in a case where the vehicle travels at each vehicle speed $V_a$~$V_e$ which are equal to or less than the predetermined vehicle speed $V_{TH}$ and the engine revolution speed Ne is equal to or greater than the predetermined revolution speed $Ne_{TH}$. A relationship of these vehicle speeds $V_a$~$V_e$ is $0<V_a<V_b<V_c<V_d\leq V_e\leq V_{TH}$.

In this FIG. 2, the ATF temperature $T_{ATFt}$ (hereinafter, simply called the "ATF temperature $T_{ATFt}$") of a drain quite close to the torque converter 2 which corresponds to the ATF temperature in the torque converter 2 is measured by a sensor in the above predetermined conditions, and this measured ATF temperature $T_{ATFt}$ is set to a vertical axis. A lateral axis indicates time.

An indemnification temperature $T_{TH}$ on the vertical axis is an upper limit temperature to indemnify performance or function of the ATF. Further, a temperature $T_L$ on the vertical axis is the ATF temperature $T_{ATFt}$ at a start of the experiment which is set to the same temperature as the above predetermined temperature $T_{co}$.

As shown in FIG. 2, regarding the vehicle speed $V_a$, the ATF temperature $T_{ATFt}$ reaches the indemnification temperature $T_{TH}$ at time $t_a$. Regarding the vehicle speed $V_b$, the ATF temperature $T_{ATFt}$ reaches the indemnification temperature $T_{TH}$ at time $t_b$ after time $t_a$. Regarding the vehicle speed $V_c$, the ATF temperature $T_{ATFt}$ reaches the indemnification temperature $T_{TH}$ at time $t_c$ after time $t_b$. Regarding the vehicle speed $V_d$, the ATF temperature $T_{ATFt}$ reaches the indemnification temperature $T_{TH}$ at time $t_d$ after time $t_c$. Regarding the vehicle speed $V_e$, the ATF temperature $T_{ATFt}$ reaches the indemnification temperature $T_{TH}$ at time $t_e$ after time $t_d$.

That is, FIG. 2 shows a temperature increase characteristic indicating that as the vehicle speed V becomes higher, temperature increase of the ATF temperature $T_{ATFt}$ becomes gentler.

The count-up values $Kp_1$~$Kp_4$ are set on the basis of this temperature increase characteristic. More specifically, as shown in the following Table 1, the count-up values $Kp_1$~$Kp_4$ are set so that as the vehicle speed V becomes higher, the count-up value becomes smaller. That is, as the count-up values $Kp_1$~$Kp_4$, values to which weights according to the increase characteristic of the ATF temperature $T_{ATFt}$ are assigned or added are set.

TABLE 1

| | vehicle speed V | | | |
|---|---|---|---|---|
| | $0 \le V \le V_{SP1}$ | $V_{SP1} < V \le V_{SP2}$ | $V_{SP2} < V \le V_{SP3}$ | $V_{SP3} < V \le V_{TH}$ |
| Kp | $Kp_1$ | $Kp_2$ | $Kp_3$ | $Kp_4$ |

$Kp_1 > Kp_2 > Kp_3 > Kp_4$

In Table 1, any of the vehicle speeds $V_{SP1}$~$V_{SP3}$ is equal to or less than the predetermined vehicle speed $V_{TH}$, and a relationship of the vehicle speed $V_{SP1}$~$V_{SP3}$ is $V_{SP1}<V_{SP2}<V_{SP3}$. Further, a relationship of the count-up values $Kp_1$~$Kp_4$ is $Kp_1>Kp_2>Kp_3>Kp_4$.

Next, time-variation of the count value Kp by the vehicle speed will be explained with reference to FIG. 3.

Figure 3:
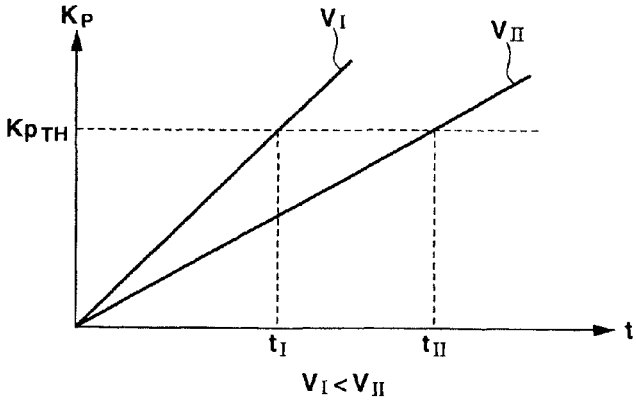
FIG. 3 is a diagram showing time-variation of a count value by the vehicle speed, used for an output suppression control that is performed by the vehicle engine output control apparatus according to one embodiment of the present invention.

FIG. 3 shows the time-variation of count values Kp for vehicle speeds $V_I$ and $V_{II}$ in a case where the both agreement of the stall judgment precondition and the stall condition continue and also the vehicle speed $V_{II}$ and the vehicle speed $V_I$ that is lower than the vehicle speed $V_{II}$, both of which are equal to or less than the predetermined vehicle speed $V_{TH}$ (in the extremely low speed region), are maintained. Here, in an actual control, although the count value Kp varies stepwise at a unit of the control interval, this variation is shown continuously in FIG. 3.

In this FIG. 3, in the above predetermined conditions, a vertical axis indicates the count value Kp, and a lateral axis indicates time. The count threshold value $Kp_{TH}$ on the vertical axis is previously set as a count value corresponding to the above indemnification temperature $T_{TH}$.

As shown in FIG. 3, regarding the vehicle speed $V_I$, the count value Kp reaches the count threshold value $Kp_{TH}$ at time $t_I$. Regarding the vehicle speed $V_{II}$, the count value Kp reaches the count threshold value $Kp_{TH}$ at time $t_{II}$ after time $t_I$.

That is, FIG. 3 shows that, since if the both agreement of the stall judgment precondition and the stall condition continue, the count-up values $Kp_1$~$Kp_4$ are added to the count value Kp by the ATCU 60 at each predetermined control interval, an increase of the count value Kp of the vehicle speed $V_{II}$ becomes gentler than that of the vehicle speed $V_I$.

Further, because when the agreement period of the stall condition is cumulated, the count value Kp reaches the count threshold value $Kp_{TH}$, the control start condition is satisfied. Furthermore, since the weight is assigned or added to the count value Kp in accordance with the vehicle speed in the extremely low speed region, the torque-down control is set so that as the vehicle speed V becomes higher in the extremely low speed region, the start of the torque-down control is delayed (retarded).

[3.2.4. Count-Down and Count-Maintaining of Count Value]

The ATCU 60 performs the count operation that subtracts count-down values $Kp_5$~$Kp_7$ from the count value Kp or the count operation that maintains the count value Kp in accordance with various vehicle states when judging that either one of the stall judgment precondition and the stall condition is not satisfied by the judgment control.

More specifically, as shown in the following Table 2, the count-down operation that subtracts count-down values $Kp_5$~$Kp_7$ from the count value Kp and the count-maintaining operation that maintains the count value Kp (Kp=Kp) are executed.

TABLE 2

| shift range | un-drive range | drive range | |
|---|---|---|---|
| stall condition | $Kp = Kp - Kp_5$ | stall condition is not satisfied | |
| torque-down control | | there is no execution history | there is an execution history |
| idle SW OFF | | $Kp = Kp - Kp_6$ | $Kp = Kp$ |
| idle SW ON | | | $Kp = Kp - Kp_7$ |

$Kp_5 > Kp_6$, $Kp_5 > Kp_7$

In the following description, the count operation shown in Table 2 will be explained by the vehicle state.

[3.2.4.1. Count-Down when Stall Judgment Precondition is not Satisfied]

As shown in Table 2, in a case where the shift range is the un-drive range, namely when the stall judgment precondition is not satisfied (i.e. upon the disagreement of the stall judgment precondition), the count operation (the count-down operation) that subtracts the count-down value $Kp_5$ from the count value Kp is executed. That is, the ATCU 60 performs the count-down of the count value Kp upon the selection of the un-drive range by which the power transmission of the automatic transmission 3 connected to the turbine 22 of the torque converter 2 is cut (disconnected).

While the ATF temperature increases in the stall state of the torque converter 2, the ATF temperature decreases by heat radiation at the un-drive range. Thus, this temperature decrease becomes gentle. The count-down value $Kp_5$ is therefore set previously with consideration given to the decrease characteristic, due to the heat radiation, of the ATF temperature in the torque converter 2 at the un-drive range, and is set to a smaller value than the count-up values $Kp_1$~$Kp_4$.

[3.2.4.2. Count-Down and Count-Maintaining when Stall Condition is not Satisfied]

As shown in Table 2, in a case where the shift range is the drive range and also the stall condition is not satisfied, if there is no execution history of the torque-down control (if the state is before the start of the torque-down control), the count operation (the count-down operation) that subtracts the count-down value $Kp_6$ from the count value Kp is executed. That is, when judging the disagreement of the stall condition (when judging that the stall condition is not satisfied), if the count value Kp was not equal to nor greater than the count threshold value $Kp_{TH}$ in the past, the ATCU 60 performs the count-down of the count value Kp.

This count-down value $Kp_6$ is a value that is previously set with consideration given to the decrease characteristic of the ATF temperature in the torque converter 2 in the case where the stall condition is not satisfied and the state is before the start of the torque-down control, i.e. at a normal travel.

On the other hand, in the case where the shift range is the drive range and also the stall condition is not satisfied, if there is an execution history of the torque-down control (if the state is after the start of the torque-down control), the count operation of the count value Kp is executed according to ON or OFF of the idle switch 80, namely the presence/absence of the accelerator operation.

In this case, when the accelerator operation is performed (the idle switch 80 is OFF), the count value Kp is maintained. When the accelerator operation is not performed (the idle switch 80 is ON), the count operation (the count-down operation) that subtracts the count-down value $Kp_7$ from the count value Kp is executed. That is, in the case where the ATCU 60 judges the disagreement of the stall condition and the count value Kp was equal to nor greater than the count threshold value $Kp_{TH}$ in the past, if ON information is inputted from the idle switch 80, the ATCU 60 performs the count-down of the count value Kp, while if OFF information is inputted from the idle switch 80, the ATCU 60 maintains the count value Kp.

Here, in the case where the stall condition is not satisfied and there is the execution history of the torque-down control and further the accelerator operation is performed (the idle switch 80 is OFF) (i.e. in the case where the count value Kp is maintained), since the state is after the start of the torque-down control, it is estimated that the ATF temperature in the torque converter 2 is high. Because of this, it is conceivable that a balance between the temperature decrease due to the heat radiation and temperature increase due to the occurrence of the slip in the torque converter 2 by the accelerator operation is achieved then the ATF temperature in the torque converter 2 almost does not change. For this reason, the count value Kp corresponding to the ATF temperature in the torque converter 2 is maintained.

The count-down value $Kp_7$ is a value that is previously set with consideration given to the decrease characteristic of the ATF temperature in the torque converter 2 during the execution of the torque-down control at the normal travel in the case where the stall condition is not satisfied and the execution history of the torque-down control exists.

As explained above, the count-down values $Kp_6$ and $Kp_7$ of the case where the shift range is the drive range and also the stall condition is not satisfied are the values used for estimation of the ATF temperature in the torque converter 2 at the normal travel. On the other hand, the count-down value $Kp_5$ of the case where the shift range is the un-drive range is the value used for estimation of the ATF temperature in the torque converter 2 when there is no slip in the torque converter 2 or there is almost no slip in the torque converter 2. That is, since the ATF temperature easily decreases at the un-drive range as compared with that at the drive range, the count-down values $Kp_6$ and $Kp_7$ used at the drive range are set to be smaller than the count-down value $Kp_5$ used at the un-drive range.

[Operation and Effect]

Figure 4:
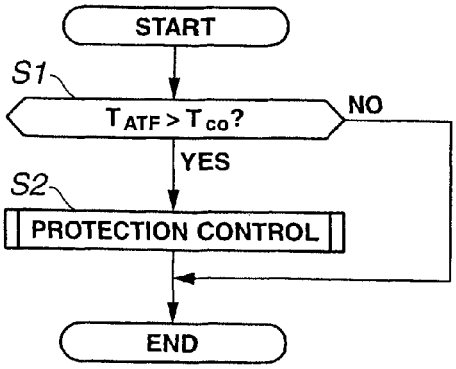
FIG. 4 is a flow chart showing judgment of a precondition (a prerequisite) for the performance of the control by the vehicle engine output control apparatus according to one embodiment of the present invention.
Figure 5:
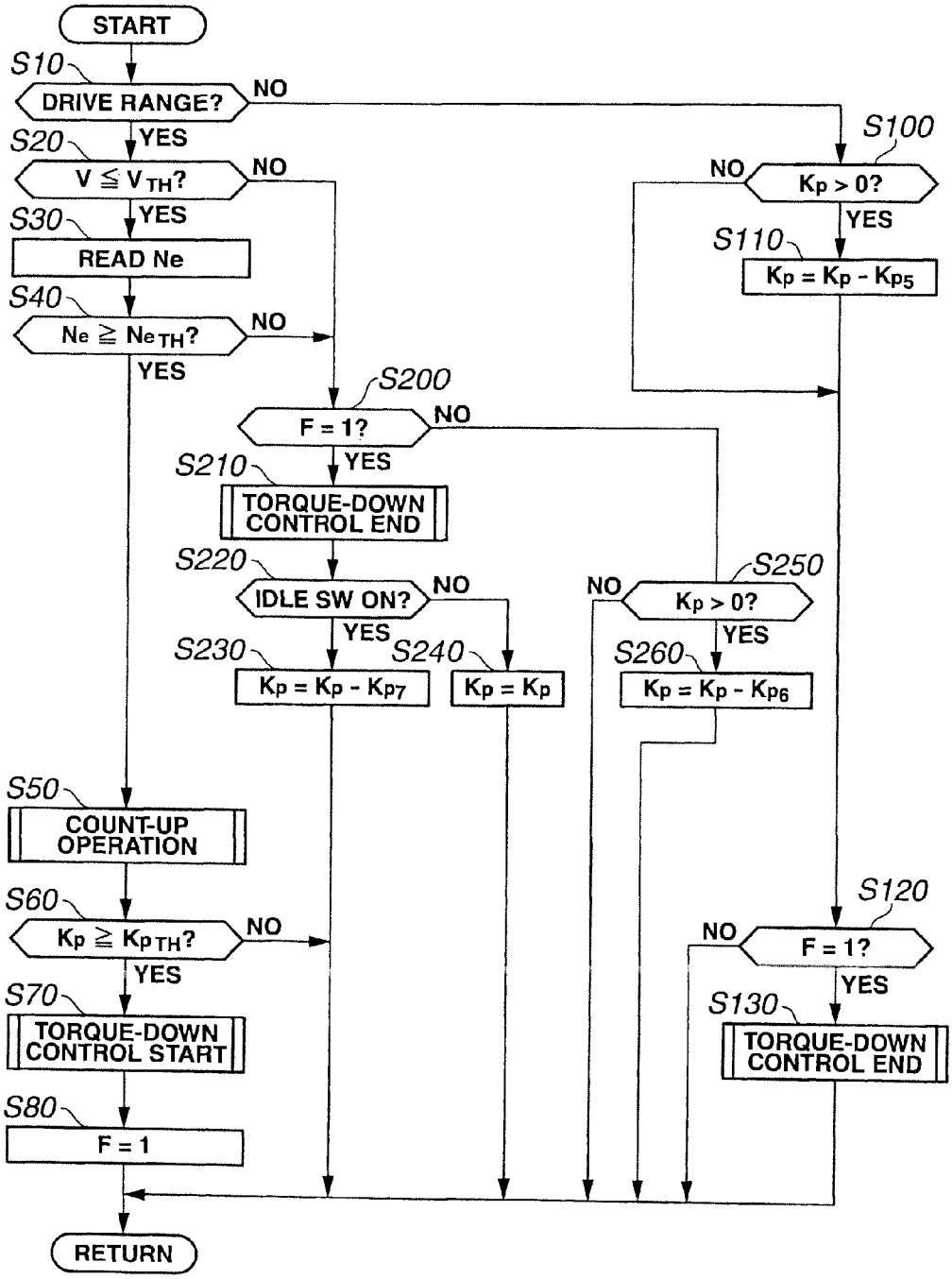
FIG. 5 is a flow chart showing judgment of conditions for a start and an end of the output suppression control and showing addition and subtraction of the count value used for this output suppression control, which is performed by a vehicle engine output suppression apparatus according to one embodiment of the present invention.
Figure 6:
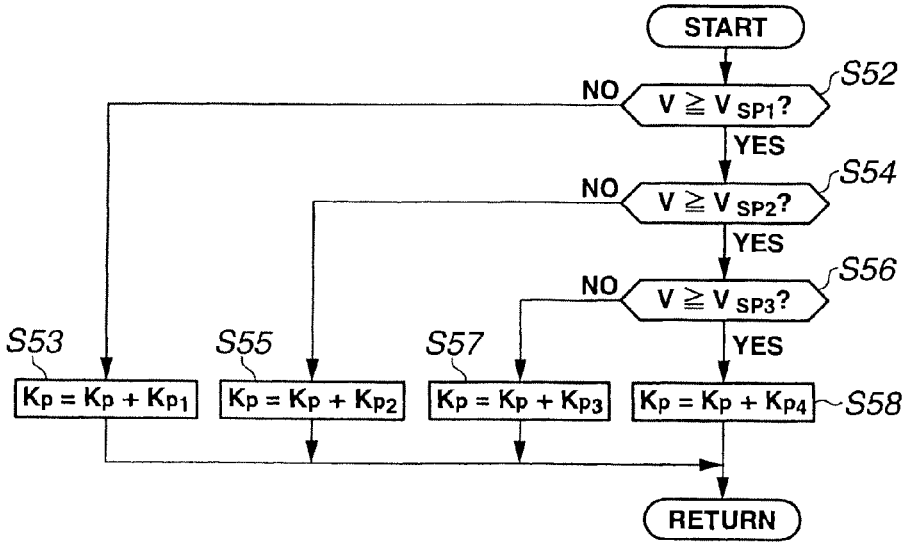
FIG. 6 is a flow chart for explaining a count-up operation in FIG. 5.

Since the engine output control apparatus of the vehicle according to one embodiment of the present invention is configured as the above configuration, the following flows shown in FIGS. 4 to 6 are executed by the ATCU 60 at the predetermined control interval.

FIG. 4 shows a judgment flow of the condition that is the prerequisite for the execution of the protection control.

At step S1, a judgment is made as to whether or not the ATF temperature $T_{ATF}$ in the oil pan 50 detected by the temperature sensor 51 is higher than the predetermined temperature $T_{co}$. If the ATF temperature $T_{ATF}$ is higher than the predetermined temperature $T_{co}$, the routine proceeds to step S2, and the protection control is carried out. If the ATF temperature $T_{ATF}$ is equal to or lower than the predetermined temperature $T_{co}$, the judgment of a current control interval is ended.

Next, the protection control will be explained in detail using the flow in FIG. 5 that shows a detail of step S2 in FIG. 4.

At step S10 in FIG. 5, a judgment is made as to whether or not the shift range detected by the shift range sensor 70 is the drive range. If the shift range is the drive range, the routine proceeds to step S20. If the shift range is the un-drive range, the routine proceeds to step S100.

Here, at step S10, the stall judgment precondition is judged.

At step S20, a judgment is made as to whether or not the vehicle speed V detected by the vehicle speed sensor 39 is equal to or less than the predetermined vehicle speed $V_{TH}$. If the vehicle speed V is equal to or less than the predetermined vehicle speed $V_{TH}$, the routine proceeds to step S30. If the vehicle speed V is higher than the predetermined vehicle speed $V_{TH}$, the routine proceeds to step S200.

At step S30, the engine revolution speed Ne inputted from the ECU 10 is read.

At step S40, a judgment is made as to whether or not this engine revolution speed Ne is equal to or greater than the predetermined revolution speed $Ne_{TH}$. If the engine revolution speed Ne is equal to or greater than the predetermined revolution speed $Ne_{TH}$, the routine proceeds to step S50. If the engine revolution speed Ne is less than the predetermined revolution speed $Ne_{TH}$, the routine proceeds to step S200.

Here, at these steps S20 to S40, the condition (the stall condition) for judging whether the torque converter is in the stall state is judged. Further, the steps S10 to S40 indicate a flow of the judgment control that judges the judgment condition (the stall judgment precondition and the stall condition). A route of "YES" at step S40 indicates a case where the judgment condition is satisfied.

At step S50, the count-up operation that adds the count-up values $Kp_1$~$Kp_4$ according to the vehicle speed V to the count value Kp is carried out.

In the following description, this count-up operation will be explained with reference to FIG. 6 that shows a detail of the count-up operation. As described above, the count-up values $Kp_1$~$Kp_4$ shown in FIG. 6 have the relationship of $Kp_1>Kp_2>Kp_3>Kp_4$. Also, the vehicle speed $V_{SP1}$~$V_{SP3}$ have the relationship of $0<V_{SP1}<V_{SP2}<V_{SP3}\leq V_{TH}$, as described above.

At step S52, a judgment is made as to whether or not the vehicle speed V is equal to or greater than the vehicle speed $V_{SP1}$. If the vehicle speed V is equal to or greater than the vehicle speed $V_{SP1}$, the routine proceeds to step S54. If the vehicle speed V is less than the vehicle speed $V_{SP1}$, the routine proceeds to step S53.

At step S53, the count-up value $Kp_1$ is added to the count value Kp. Then, the count operation (the count-up operation) of a current control interval is ended, and the routine returns to step S60 of the flow in FIG. 5.

At step S54, a judgment is made as to whether or not the vehicle speed V is equal to or greater than the vehicle speed $V_{SP2}$. If the vehicle speed V is equal to or greater than the vehicle speed $V_{SP2}$, the routine proceeds to step S56. If the vehicle speed V is less than the vehicle speed $V_{SP2}$, the routine proceeds to step S55.

At step S55, the count-up value $Kp_2$ is added to the count value Kp. Then, the count operation (the count-up operation) of a current control interval is ended, and the routine returns to step S60.

At step S56, a judgment is made as to whether or not the vehicle speed V is equal to or greater than the vehicle speed $V_{SP3}$. If the vehicle speed V is equal to or greater than the vehicle speed $V_{SP3}$, the routine proceeds to step S58. If the vehicle speed V is less than the vehicle speed $V_{SP3}$, the routine proceeds to step S57.

At step S57, the count-up value $Kp_3$ is added to the count value Kp. Then, the count operation (the count-up operation) of a current control interval is ended, and the routine returns to step S60.

At step S58, the count-up value $Kp_4$ is added to the count value Kp. Then, the count operation (the count-up operation) of a current control interval is ended, and the routine returns to step S60 of the flow in FIG. 5, likewise.

At step S60 in FIG. 5, a judgment is made as to whether or not the count value Kp is equal to or greater than the count threshold value $Kp_{TH}$. If the count value Kp is equal to or greater than the count threshold value $Kp_{TH}$, the routine proceeds to step S70. If the count value Kp is smaller than the count threshold value $Kp_{TH}$, the routine proceeds to "RETURN". This "RETURN" means a route (or a shift) to "END" shown in FIG. 4. "RETURN" described below also means the route to "END" in FIG. 4, likewise.

At this step S60, the control start condition of the torque-down control is judged.

At step S70, the instruction signal of the control start is outputted to the ECU 10, and the torque-down control is started. And at step S80, the count value Kp already becomes equal to or greater than the count threshold value $Kp_{TH}$, and a flag F is set to "1", then the routine proceeds to "RETURN". This flag F is set to "1" if the execution history of the torque-down control exists (if the state is after the start of the torque-down control), and is set to "0" if there is no execution history of the torque-down control (if the state is before the start of the torque-down control). An initial value of the flag F is set to "0".

At step S100, a judgment is made as to whether or not the count value Kp is greater than 0. If the count value Kp is 0 or smaller than 0, the routine proceeds to step S120 without any operation. If the count value Kp is greater than 0, the routine proceeds to step S110.

At step S110, the count operation (the count-down operation) that subtracts the count-down value $Kp_5$ from the count value Kp is executed, and the routine proceeds to step S120.

At step S120, a judgment is made as to whether or not the flag F is "1". If the flag F is "1", the routine proceeds to step S130. If the flag F is "0", the routine proceeds to "RETURN".

At step S130, the instruction signal of the control end is outputted to the ECU 10, and the torque-down control is terminated, then the routine proceeds to "RETURN".

At step S200, a judgment is made as to whether or not the flag F is "1". If the flag F is "1", the routine proceeds to step S210. If the flag F is "0", the routine proceeds to step S250.

At step S210, as same as step S130, the torque-down control is terminated, and the routine proceeds to step S220.

At step S220, a judgment is made as to whether the idle switch 80 is ON or OFF. If the idle switch 80 is ON (the accelerator operation is not performed), the routine proceeds to step S230. If the idle switch 80 is OFF (the accelerator operation is performed), the routine proceeds to step S240.

At step S230, the count operation (the count-down operation) that subtracts the count-down value $Kp_7$ from the count value Kp is executed, and the routine proceeds to "RETURN".

At step S240, the count operation (the count-maintaining operation) that maintains the count value Kp (Kp=Kp) is executed, and the routine proceeds to "RETURN".

At step S250, a judgment is made as to whether or not the count value Kp is greater than 0. If the count value Kp is 0 or smaller than 0, the routine proceeds to "RETURN" without any operation. If the count value Kp is greater than 0, the routine proceeds to step S260.

At step S260, the count operation (the count-down operation) that subtracts the count-down value $Kp_6$ from the count value Kp is executed, and the routine proceeds to "RETURN".

Figure 7A:
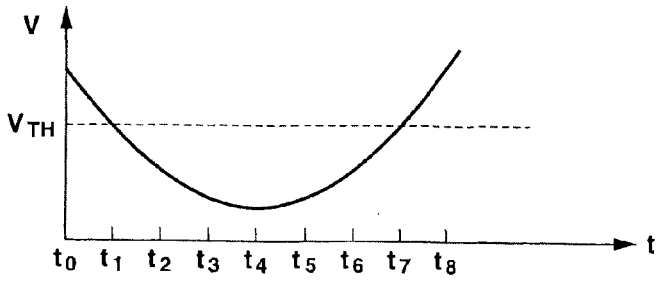
FIGS. 7A and 7B are drawings showing an example of time-variation of the count value according to the vehicle speed, used for the output suppression control.
Figure 7B:
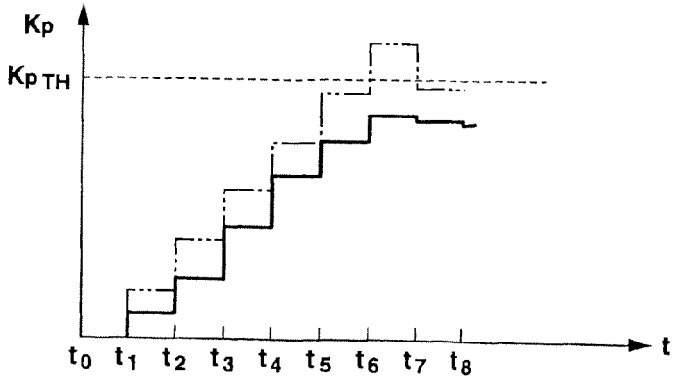

As described above, since the operation flow by the ATCU 60 is executed, in a vehicle travel state shown, as an example, in FIGS. 7A and 7B, the following count operation is executed.

FIG. 7A shows time-variation of the vehicle speed V, and FIG. 7B shows time-variation of the count value Kp, with both time series brought into alignment with each other. In FIG. 7B, the count value Kp that undergoes the count operation by the ATCU 60 is indicated by a solid line. A count value corresponding to the related art control that suppresses the stall state of the torque converter is indicated by a two-dot chain line.

In FIG. 7A, the vehicle travel state shows that, between time $t_0$~time $t_1$, the vehicle speed V is greater than or equal to the predetermined vehicle speed $V_{TH}$, between time $t_1$~time $t_7$, the vehicle speed V falls below the predetermined vehicle speed $V_{TH}$ (is less than the predetermined vehicle speed $V_{TH}$), and the vehicle speed V becomes equal to or greater than the predetermined vehicle speed $V_{TH}$ again after time $t_7$. With regard to the vehicle speed V between time $t_1$~time $t_7$, the vehicle speed V increases at (or from) time $t_4$ after the vehicle speed V decreases in the extremely low speed region of the predetermined vehicle speed $V_{TH}$ or less.

In the following description, the count value Kp at the same time $t_0$~time $t_8$ will be explained with reference to FIG. 7B.

First, the count value Kp that undergoes the count operation by the ATCU 60 according to the present invention, which is indicated by the solid line, will be explained.

Between time $t_0$~time $t_1$, since the vehicle speed V is equal to or greater than the predetermined vehicle speed $V_{TH}$, the count-up operation of the count value Kp is not carried out. Between time $t_1$~time $t_7$ that is the extremely low speed region in which the vehicle speed V is equal to or less than the predetermined vehicle speed $V_{TH}$, the count-up operation of the count value Kp is carried out.

Between this time interval time $t_1$~time $t_7$, the count-up value to which the weight according to the vehicle speed V is assigned is added to the count value Kp, namely that the count-up value set so that as the vehicle speed V becomes higher, the count-up value becomes smaller is added to the count value Kp. Therefore, at time at which the vehicle speed V is relatively high, a small count-up value is added to the count value Kp. At time at which the vehicle speed V is relatively low, a great count-up value is added to the count value Kp.

Here, since the count value Kp at time $t_7$ does not reach the count threshold value $Kp_{TH}$, the torque-down control is not carried out.

Then, after time $t_7$, since the vehicle speed V is equal to or greater than the predetermined vehicle speed $V_{TH}$ and the torque-down control is not carried out, the count-down operation of the count value Kp is performed.

On the other hand, with regard to the related art control that suppresses the stall state of the torque converter, if the vehicle speed is in the extremely low speed region, the related art uniformly (or indiscriminately) starts the torque-down control etc. after a lapse of a predetermined time. Thus, this is equivalent to (or corresponds to) a control in which if the vehicle speed is in the extremely low speed region, a uniform count-up value is added to the count value. Time-variation of this count value is indicated by the two-dot chain line.

As shown in FIG. 7B, the count value Kp of the present invention does not reach the count threshold value $Kp_{TH}$ by taking account of the characteristic indicating that the increase of the ATF temperature according to the vehicle speed becomes gentler, thereby preventing the torque-down control from being started. On the other hand, in the case of the related art control, since this control is equivalent to the control that uniformly performs the count-up of the count value, the torque-down control is started.

Accordingly, the engine output control apparatus of the vehicle of the present invention can avoid non-travelling state of the vehicle as much as possible.

Further, even if the vehicle is in the state in which the vehicle speed V is equal to or higher than the predetermined vehicle speed $V_{TH}$ which is one example of the disagreement of the stall condition, the count-down operation of the count value is performed successively to the count-up operation. Thus, even if the stall state of the torque converter 2 continually (intermittently) occurs, the torque-down control is properly started and terminated. The temperature increase and overheat of the ATF in the torque converter 2 can be therefore suppressed.

At the time of the agreement of the stall condition, since the torque converter 2 is in the stall state, the ATF temperature in the torque converter 2 increases. However, during the extremely low speed travel in which the vehicle speed V is higher than the speed of the vehicle start at which the stall occurs, the slip of the torque converter 2 becomes relatively small, and the increase of the ATF temperature in the torque converter 2 becomes relatively gentle. That is, at the time of the agreement of the stall condition, as the vehicle speed V becomes higher, the increase of the ATF temperature in the torque converter 2 becomes gentler. Under this premise, the control start condition is set so that as the vehicle speed V becomes higher, the start of the torque-down control that suppresses the output state of the engine 1 is more delayed (retarded). Thus, the control start condition is the condition set so as to delay the start of the torque-down control in accordance with the increase characteristic of the ATF temperature in the torque converter 2 which indicates that as the vehicle speed V becomes higher, the temperature increase of the ATF becomes gentler.

Therefore, in a case where a high torque is required and the vehicle travels at the extremely low vehicle speed, the stall condition is satisfied, and at this time, as the vehicle speed V becomes higher, the start of the torque-down control is more delayed. Hence, the non-travelling state of the vehicle can be avoided as much as possible, and also the temperature increase and overheat of the ATF in the torque converter 2 can be suppressed.

In addition, in the extremely low speed region in which the vehicle speed V is equal to or less than the predetermined vehicle speed $V_{TH}$, as the revolution speed Ne of the engine 1 increases, the output of the engine 1 becomes greater. However, since the engine revolution speed sensor 12 detecting the engine revolution speed Ne according to a magnitude or a quantity of the output of the engine 1 is used as the section (the engine output state detecting section) that detects the output state of the engine 1, it is possible to detect the engine output state by a simple system or configuration.

Further, the count-up values $Kp_1$~$Kp_4$ of the count operation performed by the ATCU 60 are the values to which the weights are assigned according to the increase characteristic of the ATF temperature in the torque converter 2. Thus, the count value Kp to which these count-up values $Kp_1$~$Kp_4$ are added can be treated or used as a value corresponding to the ATF temperature in the torque converter 2.

When the count value Kp becomes the count threshold value $Kp_{TH}$ corresponding to the ATF temperature $T_{TH}$ (the indemnification temperature $T_{TH}$) to indemnify performance or function of the ATF in the torque converter 2, the ATCU 60 judges that the control start condition is satisfied then starts the torque-down control. This control is equivalent to a control that starts a control to lower the ATF temperature in the torque converter 2 to be lower than the ATF temperature $T_{TH}$ corresponding to the count threshold value $Kp_{TH}$ when the ATF temperature in the torque converter 2 becomes equal to or higher than the ATF temperature corresponding to the count threshold value $Kp_{TH}$.

Consequently, the count value Kp to which the count-up values $Kp_1$~$Kp_4$ according to the increase characteristic of the ATF temperature in the torque converter 2 are added is a value that takes account of the characteristic indicating that the increase of the ATF temperature becomes gentler according to the vehicle speed V. Thus, as compared with the related art control that uniformly (or indiscriminately) starts the torque-down control after a lapse of the predetermined time if the vehicle speed V is equal to or less than the predetermined vehicle speed $V_{TH}$, it is possible to delay the start of the torque-down control. Hence, the non-travelling state of the vehicle can be avoided as much as possible, and also the temperature increase and overheat of the ATF in the torque converter 2 can be suppressed.

Furthermore, the ATCU 60 judges that the control end condition is satisfied and terminates the torque-down control when the stall judgment precondition or the stall condition is not satisfied. This control is equivalent to a control that terminates the torque-down control when the ATF temperature in the torque converter 2 corresponding to the count value Kp becomes lower than the ATF temperature $T_{TH}$ corresponding to the count threshold value $Kp_{TH}$.

Moreover, even if the stall state of the torque converter 2 continually (intermittently) occurs, the ATCU 60 executes the count-up and the count-down of the count value Kp using the count-up values $Kp_1$~$Kp_4$ and the count-down values $Kp_5$~$Kp_7$, then performs the count operation of the count value Kp corresponding to the ATF temperature in the torque converter 2. It is thus possible to properly start the torque-down control.

When the stall condition is not satisfied in the case where the execution history of the torque-down control exists (after the start of the torque-down control), if the idle switch 80 is OFF (if the accelerator operation is performed), the ATCU 60 maintains the count value Kp. Therefore, the count value Kp corresponds to the ATF temperature in the torque converter 2, and it is possible to properly start the torque-down control.

Further, when the stall condition is not satisfied in the case where there is no execution history of the torque-down control (before the start of the torque-down control), the ATCU 60 subtracts the count-down value $Kp_7$ from the count value Kp. This is a control that, when the stall condition is not satisfied, namely when the slip of the torque converter 2 is small, subtracts the count value Kp corresponding to the ATF temperature in the torque converter 2. Thus, the count value Kp used for the start of the torque-down control corresponds to the decrease of the ATF temperature in the torque converter 2, and it is possible to properly perform the torque-down control.

Furthermore, if the shift range of the automatic transmission 3 is the un-drive range, the ATCU 60 subtracts the count-down value $Kp_5$ from the count value Kp. Thus, when the shift range is the un-drive range, namely when the slip of the torque converter 2 is small or there is no slip, the count value Kp corresponding to the ATF temperature in the torque converter 2 is subtracted, and it is possible to properly perform the torque-down control.

Moreover, in the cumulative control by the ATCU 60, if the ATF temperature $T_{ATF}$ is equal to or lower than the predetermined temperature $T_{co}$, the ATCU 60 judges that the judgment condition is not satisfied. The protection control and the torque-down control are not therefore started when the ATF temperature $T_{ATF}$ in the oil pan 50 is equal to or lower than the predetermined temperature $T_{co}$, and this does not interfere a requisite increase of the ATF temperature.

Additionally, since the torque-down control is the control that stops the fuel injection for a part of or all of the cylinders in the engine 1 and stops a part of or all of fuel supply to the engine 1, this control can be performed by a simple and uncomplicated control logic.

[Modification]

Although the present invention has been explained above by the above one embodiment, the invention is not limited to the above embodiment. The following modification can be achieved as the invention.

In the following description, a modification (a modified example) of the count-down operation of the count value Kp by the ATCU 60, of the case where the shift range is the drive range and also the stall condition is not satisfied, namely during the normal travel, will be explained.

During the normal travel, the ATCU 60 performs the count operation of the count value Kp in accordance with ON/OFF of the idle switch 80, namely the presence/absence of the accelerator operation.

In this case, if the idle switch 80 is ON (the accelerator operation is not performed), the count operation that subtracts a count-down value $Kp_{6a}$ from the count value Kp is executed. If the idle switch 80 is OFF (the accelerator operation is performed), the count operation that subtracts a count-down value $Kp_{6b}$ from the count value Kp is executed.

When the accelerator operation is not performed during the normal travel, since there is no slip of the torque converter 2 or the slip is small, the ATF temperature decreases by heat radiation. On the other hand, when the accelerator operation is performed during the normal travel, since heat generation of the ATF due to the slip of the torque converter 2 to rotation-drive the pump 21 and the heat radiation of the ATF simultaneously occur, in the case where the ATF temperature decreases, its temperature decrease characteristic is a relatively gentle decrease.

In the present modification, this decrease characteristic of the ATF temperature during the normal travel is taken into consideration, then the count-down value $Kp_{6b}$ of the case where the accelerator operation is performed during the normal travel is set to be smaller than the count-down value $Kp_{6a}$ of the case where the accelerator operation is not performed.

The other configuration is the same as that of the above one embodiment.

Figure 8:
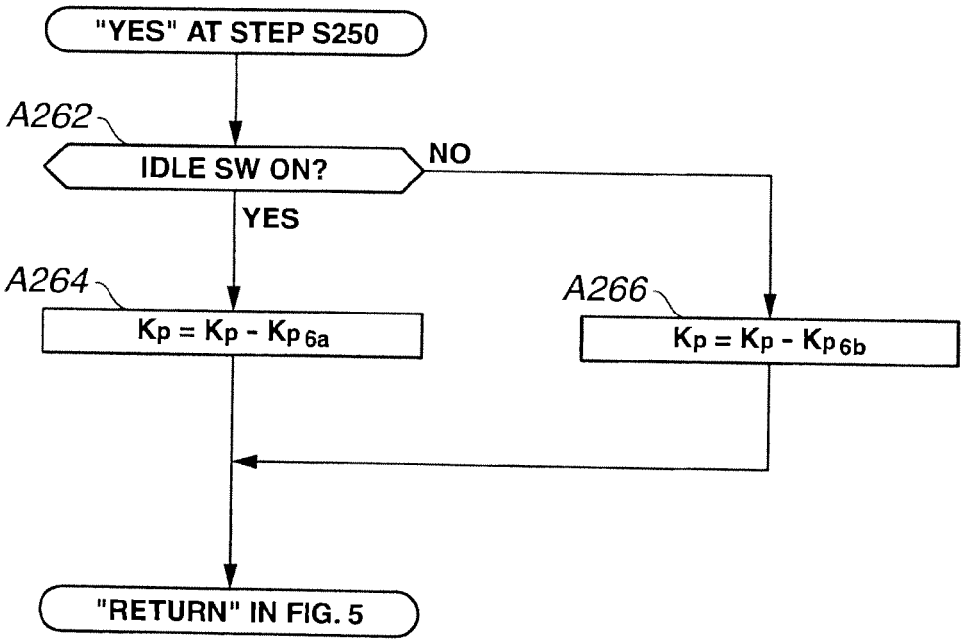
FIG. 8 is a flow chart showing a modification of the subtraction of the count value according to one embodiment of the present invention.

Since the ATCU 60 of the present modification is configured as described above, a flow shown in FIG. 8 is executed. FIG. 8 is the flow that shows a count-down routine used instead of step S260 in FIG. 5. Steps except this step S260 are used in the present modification as same as the above one embodiment.

At step S262, a judgment is made as to whether the idle switch 80 is ON or OFF. If the idle switch 80 is ON (the accelerator operation is not performed), the routine proceeds to step S264. If the idle switch 80 is OFF (the accelerator operation is performed), the routine proceeds to step S266.

At step S264, the count operation (the count-down operation) that subtracts the count-down value $Kp_{6a}$ from the count value Kp is executed. Then, the routine proceeds to "RETURN" in FIG. 5 and a current control interval is ended.

At step S266, the count operation (the count-down operation) that subtracts the count-down value $Kp_{6b}$ from the count value Kp is executed. Then, the routine proceeds to "RETURN" in FIG. 5 and a current control interval is ended.

Therefore, according to an engine output suppression apparatus of the vehicle of the present invention, the count-down value $Kp_{6b}$ of the case where the accelerator operation is performed during the normal travel is set to be smaller than the count-down value $Kp_{6a}$ of the case where the accelerator operation is not performed, and the ATCU 60 performs the count operation subtracting the count-down values $Kp_{6a}$, $Kp_{6b}$ that take account of the decrease characteristic of the ATF temperature from the count value Kp used for the start judgment and the end judgment of the torque-down control. It is thus possible to properly start and terminate the torque-down control. With this control, the non-travelling state of the vehicle can be avoided as much as possible, and also the temperature increase and overheat of the ATF in the torque converter 2 can be suppressed.

[Variation]

Although the present invention has been explained above by the above embodiments (the one embodiment and the modification), the invention is not limited to the above embodiments. The following variation can be achieved as the invention.

In the above embodiments, the stall judgment precondition is "the shift range is the drive range". However, this is not limited to "the shift range is the drive range". As the stall judgment precondition, "the shift range is not the N-range" could be used. According to this stall judgment precondition, in a case where the P-range is selected, since the ATCU 60 could judge that the torque converter is in the stall state, the torque-down control is carried out also when the P-range is selected. Thus, the temperature increase and overheat of the ATF in the torque converter 2, caused by the fact that, for instance, the driver performs the accelerator operation by mistake upon the selection of the P-range, can be therefore suppressed.

Further, in the embodiments, as the sensor that detects the engine output state, the engine revolution speed sensor is used. However, this is not limited to the engine revolution speed sensor. For instance, it is possible to use a sensor or a section that detects or calculates the engine output torque on the basis of the fuel injection quantity or an intake air flow quantity. In this case, regarding the stall condition, instead of the condition of (2), "the engine output torque is equal to or greater than a predetermined torque" is used as the condition, and this predetermined torque is previously set as a torque corresponding to the high output state of the engine.

Moreover, although the above embodiments indicate that the control start condition for starting the torque-down control is satisfied when the count value is equal to or greater than the count threshold value, this count threshold value could be set so that, according to an average of each speed (an average speed) upon the agreement of the judgment condition, as the average speed becomes higher, the count threshold value becomes greater. In this case, it is possible to use a uniform count-up value regardless of the vehicle speed. According to this setting, the control start condition is set so that as the average speed becomes higher, the start of the torque-down control is more delayed (retarded). Hence, as same as the above embodiments, the non-travelling state of the vehicle can be avoided as much as possible, and also the temperature increase and overheat of the ATF in the torque converter can be suppressed.

Furthermore, the vehicle having the controllers or the control units of the ATCU and the ECU is shown in the above embodiments. However, it is possible to use a single controller or a single unit having a combined function of the ATCU and the ECU. In addition, another ECU could be provided between the ATCU and the automatic transmission, or between the ATCU and the ECU, or between the ECU and the engine.

Additionally, although the above embodiments indicate the idle switch, a sensor that detects the presence/absence of driver's accelerator operation could be used instead of the idle switch. Also, an accelerator position sensor or an ON/OFF switch installed at the accelerator pedal might be used.

The engine output control apparatus of the vehicle of the present invention can be used for various vehicles having the torque converter.

The entire contents of Japanese Patent Application No. 2012-074954 filed on Mar. 28, 2012 are incorporated herein by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. An engine output control apparatus of a vehicle, the vehicle mounting thereon an automatic transmission that transmits an engine output inputted through a torque converter to driving wheels of the vehicle, the engine output control apparatus comprising:

a shift range detecting section that detects a shift range of the automatic transmission;

a vehicle speed detecting section that detects a vehicle speed of the vehicle;

an engine output state detecting section that detects an output state of an engine; and a controller that performs, on the basis of each detection information of the shift range detecting section, the vehicle speed detecting section and the engine output state detecting section, the following controls, (a) a judgment control that judges that, if the following judgment conditions (i) to (iii) are satisfied, the torque converter is in a stall state, (i) the shift range is a drive range, (ii) the vehicle speed is equal to or less than a predetermined vehicle speed, and (iii) the engine is in a high output state, (b) a cumulation control that cumulates a period of agreement of the judgment conditions if the judgment conditions are satisfied, and (c) an output suppression control that suppresses the output of the engine if a control start condition is satisfied by the cumulation of the agreement period, and the control start condition being set so that as the vehicle speed becomes higher, a start of the output suppression control is more delayed.

2. The engine output control apparatus of the vehicle as claimed in claim 1, wherein:

the engine output state detecting section is an engine revolution speed sensor that senses a revolution speed of the engine.

3. The engine output control apparatus of the vehicle as claimed in claim 1, wherein:

the cumulation control executes a count operation that adds a count-up value to a count value at a predetermined control interval if the judgment conditions are satisfied, the output suppression control judges that the control start condition is satisfied if the count value is equal to or greater than a predetermined count threshold value, and the count-up value are set on the basis of the vehicle speed detected at each predetermined control interval so that as the vehicle speed becomes higher, the count-up value becomes smaller.

4. The engine output control apparatus of the vehicle as claimed in claim 3, further comprising:

an accelerator operation detecting section that detects presence/absence of an accelerator operation of the vehicle, and wherein in a case where the judgment conditions are not satisfied after the start of the output suppression control, if the accelerator operation is not detected by the accelerator operation detecting section, the cumulation control executes a count operation that subtracts a count-down value from the count value, and the output suppression control judges that a control end condition is satisfied with the disagreement of the judgment conditions being the control end condition, and terminates the output suppression control.

5. The engine output control apparatus of the vehicle as claimed in claim 4, wherein:

in a case where the judgment conditions are not satisfied after the start of the output suppression control, if the accelerator operation is detected by the accelerator operation detecting section, the cumulation control executes a count operation that maintains the count value.

6. The engine output control apparatus of the vehicle as claimed in claim 3, wherein:

in a case where the judgment conditions are not satisfied before the start of the output suppression control, the cumulation control executes a count operation that subtracts a count-down value from the count value.

7. The engine output control apparatus of the vehicle as claimed in claim 3, wherein:

if the shift range of the automatic transmission is a neutral range, the cumulation control executes a count operation that subtracts a count-down value from the count value.

8. The engine output control apparatus of the vehicle as claimed in claim 1, further comprising:

a temperature sensor that senses a temperature of oil supplied to the torque converter, and wherein if the oil temperature sensed by the temperature sensor is equal to or lower than a predetermined temperature, the controller judges that the judgment conditions are not satisfied.

9. The engine output control apparatus of the vehicle as claimed in claim 1, wherein:

the output suppression control is a control that stops a part of or all of fuel supply to the engine.

* * * * *